United States Patent [19]

Boulle et al.

[11] Patent Number: 4,519,540

[45] Date of Patent: May 28, 1985

[54] SEALED GAS HEATER WITH FORCED DRAFT AND REGULATION BY MICROPROCESSOR

[75] Inventors: Franck Boulle, Lagny sur Marne; Michel Zveguintzoff, Chatenay-Malabry, both of France

[73] Assignee: Societe Anonyme Saunier Duval eau Chaude Chauffage - S.D.E.C.C., Montreuil, France

[21] Appl. No.: 408,126

[22] Filed: Aug. 13, 1982

[30] Foreign Application Priority Data

Aug. 27, 1981 [FR] France ..... 81 16373

[51] Int. Cl.[3] ..... F24H 3/06

[52] U.S. Cl. ..... 237/7; 431/12; 236/15 BD; 236/14; 364/505

[58] Field of Search ..... 237/8 R; 126/116 A; 431/76, 12; 236/91 F, 15 BD, 14; 364/505

[56] References Cited

U.S. PATENT DOCUMENTS 4,375,950 3/1983 Durley, III ..... 431/76

*Primary Examiner*—Henry Bennett

*Attorney, Agent, or Firm*—Kerkam, Stowell, Kondracki & Clarke

[57] ABSTRACT

The invention concerns a control device for gas boilers. The overall functions involving control and safety are ensured by a control box (26) with microprocessor which centralizes data collected from the ambient thermostat (27), the temperature sensor (28) on the duct (21) for heating water return, the air output sensor (19), the drawing contact (31), the extraction fan (6) speed sensor (30), and the lighter (24), and it converts them into digital signals that are made to operate the lighter, the circulation pump (19), the gas inlet electrovalve (12) and the extraction fan according to the control data that the microprocessor has memorized. Application for forced draft steamtight gas boilers.

11 Claims, 4 Drawing Figures

SEALED GAS HEATER WITH FORCED DRAFT AND REGULATION BY MICROPROCESSOR

BACKGROUND OF THE INVENTION

The invention concerns steamtight forced draft gas boilers and relates especially to a new microprocessor control mode.

In steamtight forced draft gas devices one is aware that air circulation which is needed for combusion as well as simultaneously the evacuation of burnt gases is ensured by a fan since the burner and the heating body are located inside a structure protected from the local atmosphere and connected to the outside by intake and evacuation channels and that such circulation of gaseous flow can only take place naturally in conventional boilers. This fan therefore supplies an air flow, which, when the boiler is equipped with a control that includes burner flow modulation proportionate to the needs, must be dependent on the flow of gas admitted into the device or that such flow must adapt to the potential that is required and follow therefore the fluctuations in the burner gas flow. If one uses a fan at a constant rotation speed, one knows that there are bypass systems located at the level of the hood due to which part of the absorbed air is directly diverted towards the evacuation of combustible products, the amount of air admitted inside the burner thus being just enough to ensure correct combustion at the desired potential. One prefers instead of these mechanical means, to modulate the speed of the fan from a measure taken at each point of the real air flow admitted inside the burner, electronic means that ensure such a dependency. Control must therefore centralize first and foremost at each moment the exact data concerning the real air flow and the speed of the fan since one knows that there is not necessarily a precise correspondence between those two parameters, for instance in the event of clogging or obstruction of the channels.

A control system must also ensure a safety function both at the time of lighting and also during the operation phase by monitoring the temperature in various areas of the device in order to rectify the excesses or lack of temperature or to place the device at safety if need be. To that end, the control must accommodate and analyze at each moment in relation to the values of specified orders, characteristic deviation signals in relation to those values, supplied by sensors.

Those function—as well as those ensuring the control of the reverse valve for the implementation of the heating circuit or of the drawing circuit—are ensured by control systems that make use of analog circuits which transform the signals received from those various sensors into voltage or intensity variations that are compared to the specific order values inside a comparator, then amplified with an amplifier the output of which leads to the motor organ which is, for instance, the burner gas intake electromagnetic sluice gate.

Those known implementation modes, however, display some disadvantages. First of all, they use a fair amount of components and they require a special assembly. Furthermore, one knows that the specific order values are provided by the various components in use, resistances, capacities, etc.; if one wishes to alter the values, one may have to alter the components. Which means that analog control, once it is denied for a device with specific values, cannot adapt easily to other parameters without a change in the components, or, without questioning the design of the circuits. It is a serious disadvantage in the manufacturing process because often there is a need for adapting in time devices to the needs and habits of the customers while taking into account other patterned criteria, like energy savings, new safety measures, etc. Moreover, it would be difficult for this type of control to take into consideration some outer characteristics of a heating system such as the ultimate closing of all the thermostatic faucets that equip the radiators and prevent therein their discrepancies by way of the automatic introduction of time-delay on specific control cycle sequences.

SUMMARY OF THE INVENTION

The invention offers a microprocessor control system which prevents those disadvantages and ensures all of the control and safety functions, while allowing for verification at any time of the control card of the device through simulation of the major controls.

This microprocessor control enables, as opposed to known systems, the adaptability of systems by way of a simple change in the memory without affecting the components, it also provides a control process with integral and derivative proportionate action in a much more accurate frame and it also displays assets at the operational level.

Other specific characteristics and advantages of the invention will emerge in the course of the following description of an implementation and operating mode inside which one refers to the schematic illustration attached thereto which depicts this microprocessor control.

BRIEF DESCRIPTION OF THE DRAWINGS

The accompanying

DESCRIPTION OF PREFERRED EMBODIMENT

Figure 1:
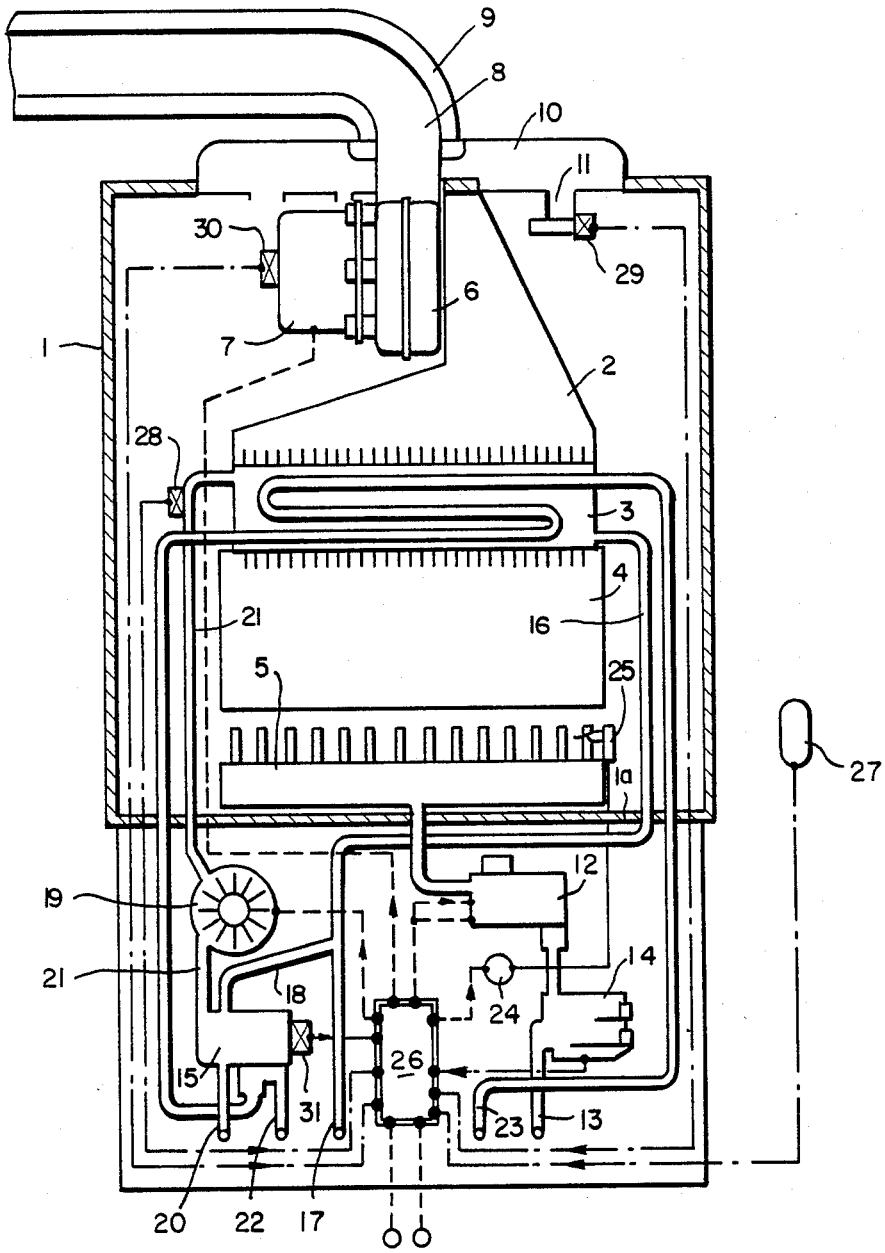
FIG. 1 shows schematically a preferred embodiment of the present invention.

The illustrated device of FIG. 1 is comprised of a steamtight frame 1, of which the bottom 1*a* isolates the steamtight section from the control mechanisms and organs that are placed in the lower section, the entire structure being assembled on the frame which is not illustrated.

Inside the steamtight frame 1, an evacuation hood 2 for burned gases that is shaped like an L covers a finned block 3 which represents the heating body of the device, of which the skirt 4 channels the gases stemming from the burners 5. On the vertical section of the hood that forms the chimney there is an extraction fan 6 that is mounted, of which the drive engine 7 takes up the space present between the hood and the upper section of the frame. The fan 6 extracts the combustible gases through an evacuation duct 8 which is coaxial, to the air intake duct 9. The latter leads inside an air distribution box 10 which is located in the upper section of the steamtight frame, itself in communication with the inner chamber through an orifice 11.

Below the steamtight bottom 1*a* one can find the various mechanisms belonging to the device: the burner gas intake electrovalve 12 supplied by a gas inlet duct 13, by way of a disconnecting box 14 which also ensures the electrical voltage state of the boiler. One also finds there the reverse valve 15 of which the closing organ which is not illustrated distributes primary hot water coming out of the exchanger through the duct 16, or towards the heating starter 16, with a return through duct 20—or towards a short circuit 18, a pump 19 interspersed along the joint return duct 21 towards the exchanger. The sanitary water circuit supplied by the inlet pipe 22 supplies water to the drawing points by way of the starter pipe for sanitary water 23. Finally a lighter 24 supplies a crown of sparks to the pilot 25.

The microprocessor control system is designed to control the terminal organs in relation to data received by sensors. The microprocessor control box 26 received to this end data from the temperature sensors such as the ambient thermostat 27 mounted externally on the device and the heating water return sensor 28 mounted on the duct 21. The data are also received from an air flow sensor 29 mounted on the air intake orifice 11 inside the steamtight frame from the distributing box 10. Those sensors, except for the ambient thermostat, issue an analog signal (variable voltage in relation to the value being measured) which must be converted into digital values that can be assimilated by the microprocessor. Furthermore, other data are supplied by a sensor 30 which is mounted onto the engine 7 of the extraction fan. Said sensor detects the passage of four magnets affixed to the tip of the engine shaft or even of a slotted plate followed by an optoelectric reader and issues a digital signal, of which the frequency is proportionate to the rotation of the engine. Moreover, datum on the drawing of sanitary water is supplied by a drawing contact 31 placed at the level of the reverse valve 15. Finally, a contact tied to the lighter 24 supplies a datum on the lighting cycle to the box 26.

The terminal organs that may be controlled in such fashion by the control system are the gas electrovalve 12, the water circulation pump 19, the lighter 24, and, inside the steamtight frame of the device, the extraction fan 6.

Figure 2:
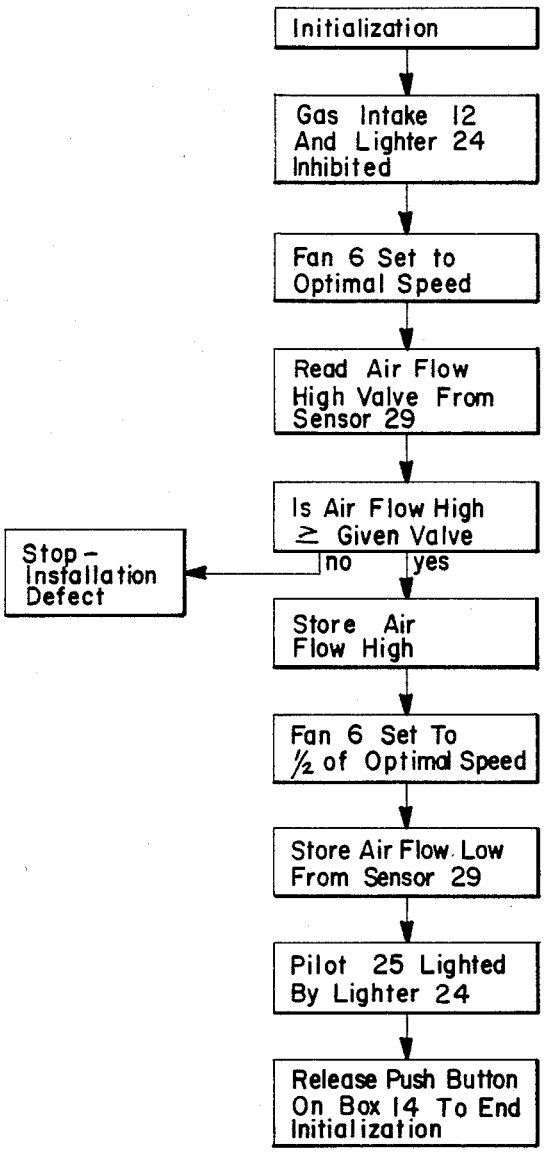
FIG. 2 shows a simplified initialization flow chart.

During the application of voltage to the device, a first sequence of initialling is designed to "teach" the microprocessor the framework within which it will control the boiler. This sequence is as follows: gas intake and the lighter 24 are inhibited; the extraction fan 6 is made operational at optimal speed then the microprocessor with the sensor 29 reads the value of air flow which crosses into the orifice 11 of the distributing box 10 to the inner chamber of the device. This value must equal a specific value below which there would be an installation defect and a stop to the programming. If this value, therefore, is normal, it is memorized after computation, as the minimal flow value corresponding to the full flow of the extraction fan. Then, the fan is switched to 50% of its optimal speed and one undertakes a new flow measure. The memorized value represents the minimal value for air flow at the low output of the fan 6. The latter is then stopped; the lighter 24 is placed under voltage in order to light the pilot 25. The release of the push-button to the disconnecting box 14 ends this initialling sequence. A simplified flow chart of this initialization process is shown in FIG. 2.

Those two flow measures are designed to standardize the air flow sensor so as to compensate for the influence of the position of sensor 29 relative to the position of fan 6.

In the course of operation, the microprocessor reads occasionally the state of the temperature sensors at the ambient thermostat 27 and at the drawing contact 31. If there is no order, the circulation pump 19 remains stalled and the extraction fan is not set in motion except very intermittently (15 seconds up to 5 minutes) and at reduced speed (50% of the nominal speed) in order to ensure the supply of air to the pilot.

As soon as an order is received from the ambient thermostat 27 or as soon as the sensed temperature is below the predetermined threshold, and there is a request for heat, the circulation pump 19 is activated; the gas intake through the electrovalve 12 and the speed of the extraction fan 6 are then modulated by the microprocessor 26 so as to ensure constant proportionality in the air-gas mixture and to maintain a heating water return temperature through the duct 20, equal to the order temperature adjusted by the user since the power can be adapted to the needs of the facility. In the event of the burner 5 stalling, the latter can be relit following a certain delay (about one minute, for instance) in order to prevent too many repetitive lighting and extinguishing cycles. Furthermore, in order to avoid overheating, the pump and the extraction fan are sustained in operating modes for some time (for instance 45 seconds) after the interruption of gas and the lighting of the burner takes place only after a phase of small output so as to ensure silent lighting. At any time, the air flow sensor 20 informs the microprocessor 26 of the air output let inside the device through the orifice 11. If the latter is inadequate to ensure correct combustion of the introduced gas, the gas output is then reduced to reach the mixture that is adapted to correct combustion.

Figure 3:
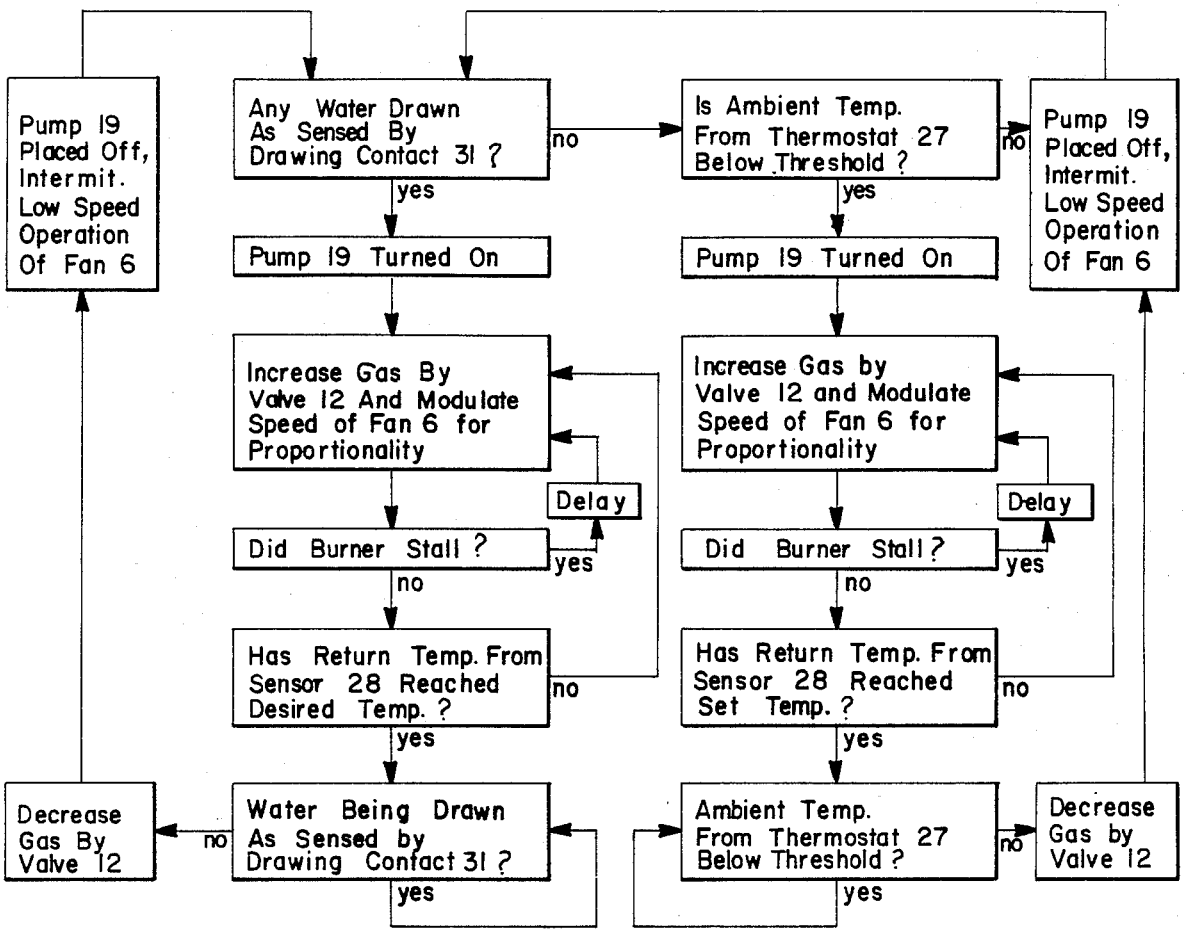
FIG. 3 shows a simplified operational flow chart.
Figure 4:
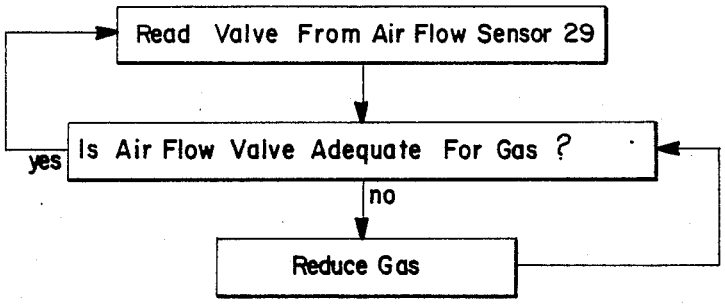
FIG. 4 shows a simplified safety flow chart.

FIG. 3 shows a simplified flow chart of the operational sequence of the present invention, whereas FIG. 4 shows a simplified flow chart of the safety checking feature of the present invention.

As soon as an order is received from the drawing contact 31, or, as soon as there is a call for calories during the drawing of water by the customer, since this call is priority in relation to heating, the microprocessor regulates the primary (16, 21) circuit which the reverse valve 15 distributes by way of the short circuit 18. This control sequence for hot water heating uses the same principles as the heating operation except that it is conducted with a set order value or desired temperature setting that enables the reaching of a satisfactory hot water temperature on the secondary drawing circuit.

This microprocessor control system also anticipates a testing program which makes it possible to verify the operation of the control card outside of the boiler by simulating commands sent to the terminal organs in relation to the data applied to the inputs.

What we claim is:

1. A control device for a simple or mixed gas boiler with forced draft in which a sealed enclosure encloses a burner, a heating body, an evacuation hood for the burned gases and an extraction fan, fresh air that is needed for the combustion of the burner being admitted from an air distribution box placed at the upper section of said enclosure, said boiler including a burner gas inlet, electrovalve that is connected to a disconnecting box, a reverse valve distributing primary water either towards a long circuit during the heating operation, or towards a short circuit during a drawing, a circulation pump and a lighter, the boiler being furthermore equipped with a plurality of sensors or detectors that are designed to collect temperature, output or operation data, characterized by the fact that the overall control, safety and uninterrupted dependency functions of air output to gas output are ensured by a control box (26)

with a microprocessor which centralizes the data received from the various sensors, converts them into digital signals ready to operate the lighter (24), the circulation pump (19), the gas inlet electro valve (12) and the extraction fan (6), according to control data that are pre-programmed and memorized by the microprocessor.

2. A control device according to claim 1 characterized by the fact that the control box (26) with microprocessor is connected to at least two temperature sensors, one being comprised of the ambient thermostat (27) and the other sensor (28) being located on the heating water return duct (21), that it is also connected to an air output sensor (29) mounted on the air passage orifice (11) of the distribution box (10), that it is also connected to a rotation speed sensor (30), mounted on the engine (7) of the extraction fan (6), and that it is finally connected to contactors which supply an initial datum on the sampling of sanitary water with a drawing contact (31), placed at the level of the reverse valve (15), and a second datum on the lighting cycle with a contact on the lighter (24).

3. A control device according to claim 2 and characterized by the fact that the introduction of control data in the microprocessor is ensured during the application of voltage to the device through the operation at optimal speed of the extraction fan (6) and the memorization of the air output value corresponding to the full output recorded by the sensor (29), followed by the operation of said fan at the reduced speed which corresponds to the air output necessary to the operation of the burner to its minimal power of the modulation bank that is planned and the memorization of the value of that reduced air output.

4. A control device according to claim 2 characterized by the fact that the microprocessor reads the temperature data supplied by the ambient thermostat (27) and the drawing data supplied by the contact (31) with a reading frequency included between 0.2 and 0.5 seconds.

5. A control device according to claim 4 characterized by the fact that without order, the circulation pump (19) remains stalled and the extraction fan (6) works only very intermittently and at a reduced speed to ensure the air supply to the pilot.

6. A control device according to claim 4 characterized by the fact that the microprocessor controls in a modulated fashion the opening of the electro valve (12) and the speed of the extraction fan (6), as soon as a request for calories is made by the ambient thermostat (27), in order to ensure proportionality continuously in the air-gas mixture and to sustain at an equal level with the order temperature the heating water return temperature through the duct (20).

7. A control device according to claim 4 characterized by the fact that the microprocessor controls the opening of the return valve (15) which then distributes water from the primary circuit (16, 21) inside the short circuit, as soon as a sampling of the sanitary water is begun by the drawing contact (31), and controls the temperature of that water at a predetermined fixed value and which makes it possible to obtain a satisfactory temperature in the secondary drawing circuit.

8. A control device according to claim 6 characterized by the fact that, in the event of a flame out of the burner (5), the microprocessor delays its relighting in order to avoid repeated lighting and extinguishing cycles.

9. A control device according to claim 8 characterized by the fact that the microprocessor controls the operational maintenance of the circulation pump (19) and of the extraction fan (6) during a period of time after a flame out of the burner.

10. A control device according to claim 9 characterized by the fact that the microprocessor ensures the relighting of the burner only after a phase of low flow in order to ensure silent lighting.

11. A control device according to claim 1 characterized by the fact that a simulation of the commands sent to the terminal member as a function of data supplied to the inputs is applied to the microprocessor control (26) to test its operating procedure.

* * * * *